US005996296A

United States Patent [19]

Bisbee

[11] Patent Number: 5,996,296

[45] Date of Patent: Dec. 7, 1999

[54] PREFABRICATED STRUCTURAL PANEL

[76] Inventor: Robert L. Bisbee, 8128 NW. Beaman, Kansas City, Mo. 64151

[21] Appl. No.: 08/986,848

[22] Filed: Dec. 8, 1997

[51] Int. Cl.[6] ..... E04B 1/00

[52] U.S. Cl. ..... 52/284; 52/264

[58] Field of Search ..... 52/289, 220.1, 52/220.2, 220.3, 262, 264, 265, 269, 293.1, 293.3, 656.1, 793.11, 795.1

[56] References Cited

U.S. PATENT DOCUMENTS

| | | | |
|---|---|---|---|
| 1,622,071 | 3/1927 | Urban, Sr. . | |
| 2,034,265 | 3/1936 | McLaughlin, Jr. . | |
| 2,114,388 | 4/1938 | Killion . | |
| 3,293,820 | 12/1966 | Smith | 52/284 |
| 3,500,595 | 3/1970 | Bennett . | |
| 3,822,519 | 7/1974 | Antoniou . | |
| 4,227,360 | 10/1980 | Balinski . | |
| 4,563,851 | 1/1986 | Long | 52/656 |
| 4,757,663 | 7/1988 | Kuhr . | |
| 4,894,974 | 1/1990 | Mayhew | 52/785 |
| 5,396,750 | 3/1995 | Kleyn | 52/802 |
| 5,493,836 | 2/1996 | Lopez-Munoz | 52/602 |
| 5,765,330 | 6/1998 | Richard | 52/309.13 |

*Primary Examiner*—Beth Aubrey
*Attorney, Agent, or Firm*—Hovey, Williams, Timmons & Collins

[57] ABSTRACT

A structural panel (20) for a prefabricated building includes a plurality of spaced, generally side-by-side tubular columns (22–28), a header and a footer (36, 38) each interconnecting the respective ends (30,32) of the columns (22–28), and a plurality of spaced, tubular cross members (40,42) interconnecting the columns (22–28) along at least one of the column sides (34). In preferred forms, the panel (20) has two end columns (22, 24) and two intermediate columns (26, 28), and the cross members (40, 42) are arranged in pairs positioned on opposite sided (34) of the columns (22–28) in registry with each other. Each cross member (40, 42) runs generally transverse to the columns (22–28) and presents a length that is not less than the distance between the two end columns (22, 24). Advantageously, the tubular columns (22–28), header and footer (36, 38) and cross members (40, 42) are comprised of sheet metal formed to present a generally rectangular cross section. The end columns (22, 24) and header and footer (36,38) each having a plurality of bolt-receiving holes (60, 62) therethrough to permit coupling of the panels (20) with each other and with a support surface (58) or roof structure (59) or both.

26 Claims, 3 Drawing Sheets

PREFABRICATED STRUCTURAL PANEL

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to prefabricated building components. More particularly, the invention pertains to a structural panel for a prefabricated building, and a corresponding method, that preferably includes a plurality of spaced, tubular steel columns, a pair of tubular steel girts each interconnecting respective ends of the columns, and a plurality of spaced, tubular steel cross members arranged in pairs and connected on opposites sides of the columns in registry with each other to accommodate various available building materials.

2. Description of the Prior Art

Prefabricated building components greatly facilitate building construction. For example, the use of standard sized structural wall panels that easily interconnect with each other typically results in reduced planning and design costs on the front end of the job, and insures rapid completion of the building in an efficient manner. Mass production of such readily installed prefabricated components contributes significantly to the overall lower construction costs usually associated with such buildings.

A number of prefabricated building panels and related components have been proposed in the past, as evidenced by the disclosures of U.S. Pat. Nos. 1,622,071, 3,822,519 and 5,257,440. The structural panels of the prior art, however, have several notable drawbacks. While such panels may in some cases be constructed of tubular members, the prior art panels will not adequately support wall panel elements (e.g., drywall paneling or exterior siding) without the addition of vertical or horizontal studs. In addition, the panels of the prior art require complicated butt straps, brackets and other similar devices to interconnect a panel with a support surface or roof structure or in a side-by-side or superposed relationship with an adjacent panel.

SUMMARY OF THE INVENTION

The problems outlined above are in large measure solved by the structural panel of the present invention. That is to say, the panel hereof is specially designed for rapid erection using a small crane or several workers, and can immediately accommodate standard or extended length wall panel elements once the structural panel is installed or factory applied and shipped as a finished component complete with interior and exterior finish including insulation. Preferably constructed of welded, tubular steel, the panel exhibits a high strength-to-weight ratio and has significant rigidity.

The structural panel of the present invention broadly includes a plurality of spaced, generally side-by-side, tubular columns, a header and a footer interconnecting the respective ends of the columns, and a plurality of spaced, tubular girts or cross members. The cross members each run generally transverse to the columns and interconnect the columns along the sides thereof. In preferred forms, the panel has two end columns and two intermediate columns, and the cross members are arranged in pairs positioned on opposite sides of the columns in registry with each other. Each cross member presents a length that is adequate to transfer construction and wind loads into the columns.

The girts are preferably welded to the column ends and the cross members are welded to the column sides. Each column is preferably received within an opening defined in an exterior surface of the girt such that the column ends engage the interior surface of the girt. By orienting the column ends within the tubular girts in such manner, loads are appropriately transferred through to the foundation or to another column (in a multi-story building situation) without crushing the tubular girts. Advantageously, the columns, girts and cross members are comprised of sheet metal formed to present a generally rectangular cross section. The tubular shape of such components inherently provide a conduit run for wire, cables and pipes. The end columns and girts have a plurality of bolt-receiving holes therethrough to permit coupling of the panels with each other and with a support surface and/or roof structure.

DETAILED DESCRIPTION OF THE PREFERRED EMBODIMENT

Figure 1:
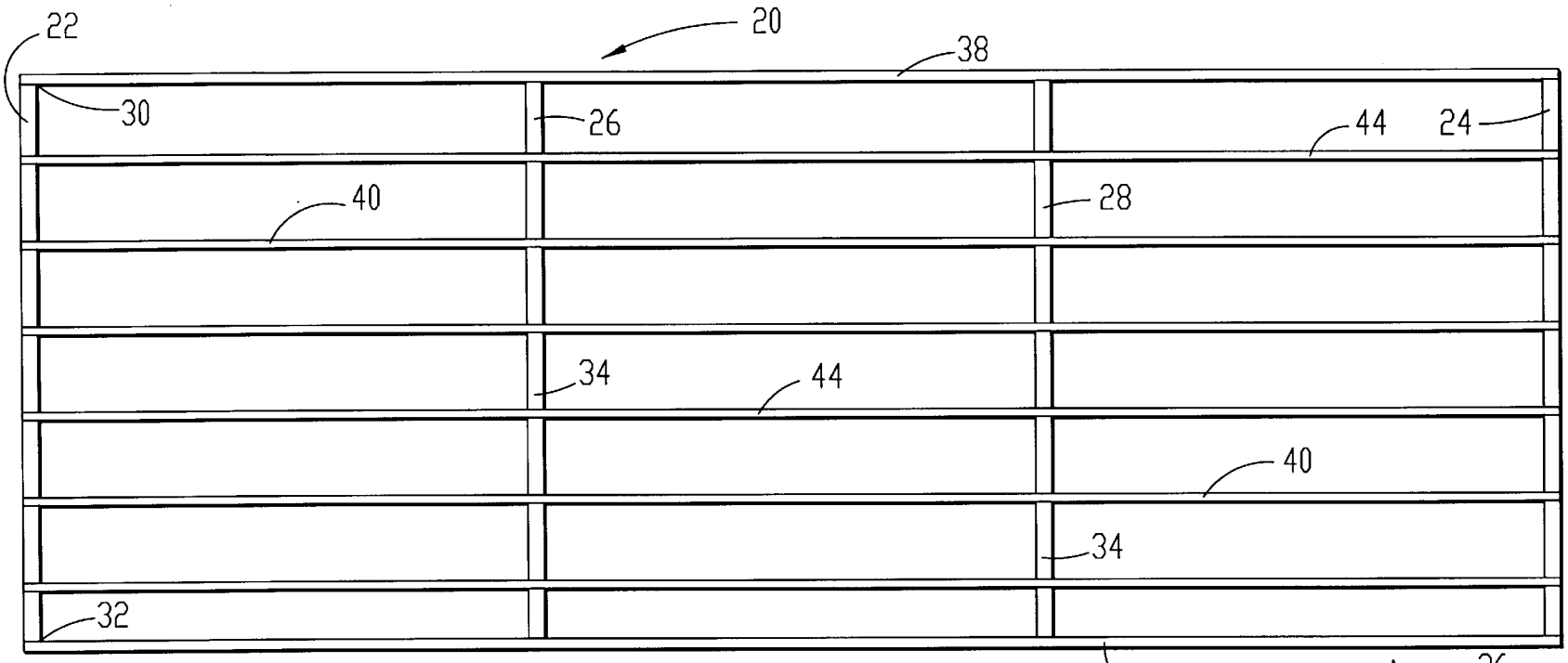
FIG. 1 is an elevational view of the structural panel in accordance with the present invention.

Referring to the drawing figures, and in particular to FIG. 1, the preferred embodiment of the structural panel 20 of the present invention is shown in an upright, erected position. As illustrated, the preferred panel 20 includes four spaced, generally side-by-side, tubular columns, comprising two end columns 22 and 24 and two intermediate columns 26 and 28. Each column 22–28 presents upper and lower ends 30 and 32 and opposing sides 34. A first girt or footer 36 is interconnected with and supports lower ends 32 of columns 22–28, and a second girt or header 38 is interconnected with and is supported by upper ends 30 of columns 22–28. Six pairs of spaced, tubular cross members 40 and 42 are interconnected with columns 22–28 along each column side 34. Each pair of cross members 40, 42 is positioned on the opposite side of columns 22–28 in registry with each other. Each cross member 40, 42 presents a length that is not less than the distance between end columns 22, 24.

Tubular columns 22–28, girts 36, 38 and cross members 40, 42 each present a generally rectangular cross section and are preferably formed from a standard-rolled, 16-gauge steel sheet having a longitudinally extending, butt-welded seam (not shown).

Advantageously, these tubular components each provide a conduit run therein that is appropriately sized for receiving wires, cables, pipes and other similar elongated building materials. To interconnect such tubular components, each girt 36, 38 is welded to respective column ends 30, 32 of each column 22–28, and each cross member 40, 42 is welded to respective column sides 34 of each column 22–28. Such welding (not shown) may be of any conventional form appropriate for tubular sheet metal components. It will be appreciated by one skilled in the art, however, that other structural materials may be substituted and other means of interconnecting (e.g., rivets and bolts) may be employed without departing from the scope of the claimed invention.

Cross members 40 or 42 positioned on one side 34 of columns 22–28 each presents an outboard face 44 that is generally co-planar with each other. Outboard faces 44 are oriented in such manner so that cross members 40,42 may be attached to and support a wall panel element 46, such as drywall, paneling or various forms of exterior siding. Attachment of wall panel elements 46 to cross members 40, 42 may be accomplished using conventional securing means, such as drywall screws (not shown). It should be noted that a builder working with the structural panel 20 of the present invention has the option of installing longer running sheets of wall panel elements 46 because cross members 40, 42 run generally horizontally. Use of such nonstandard, longer sheets results in fewer wall board joints and quicker wall finish work. This option would be basically unavailable to a builder working with vertical studs, and standard sized sheets of wall panel elements would have to used instead. The configuration of the present invention also enables the convenient placement of insulation 47 as illustrated in FIG. 3, for example.

Figure 6:
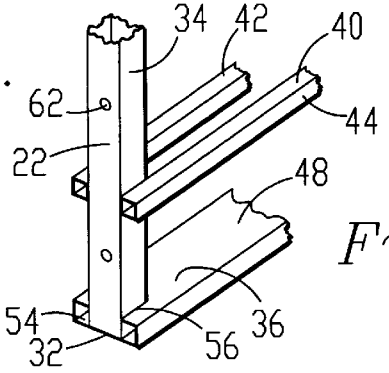
FIG. 6 is a fragmentary, pictorial view of an end column interconnecting with a footer and two cross members.
Figure 5:
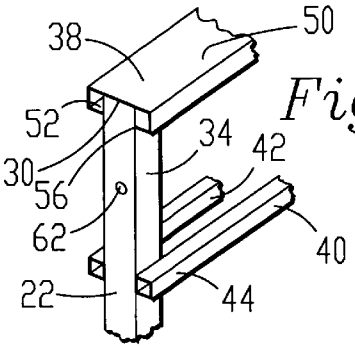
FIG. 5 is a fragmentary, pictorial view of an end column interconnecting with a header and two cross members.

Each girt 36, 38 presents opposed first and second exterior surfaces 48, 50 and opposed first and second interior surfaces 52, 54. First exterior and interior surfaces 48, 52 cooperatively define a column-receiving opening 56 therethrough. As illustrated in FIGS. 5 and 6, each end 30, 32 of columns 22–28 engages second interior surface 54 when columns 22–28 are received within the corresponding openings 56. By orienting each column end 30, 32 within girts 36, 38 in such manner, loads may be appropriately transferred between columns 22–28 in a multi-story building without crushing adjacent header and footer girts 36, 38. Similarly, loads may also be transferred from columns 22–28 to a support surface 58, such as the concrete foundation depicted in FIG. 3.

Figure 2:
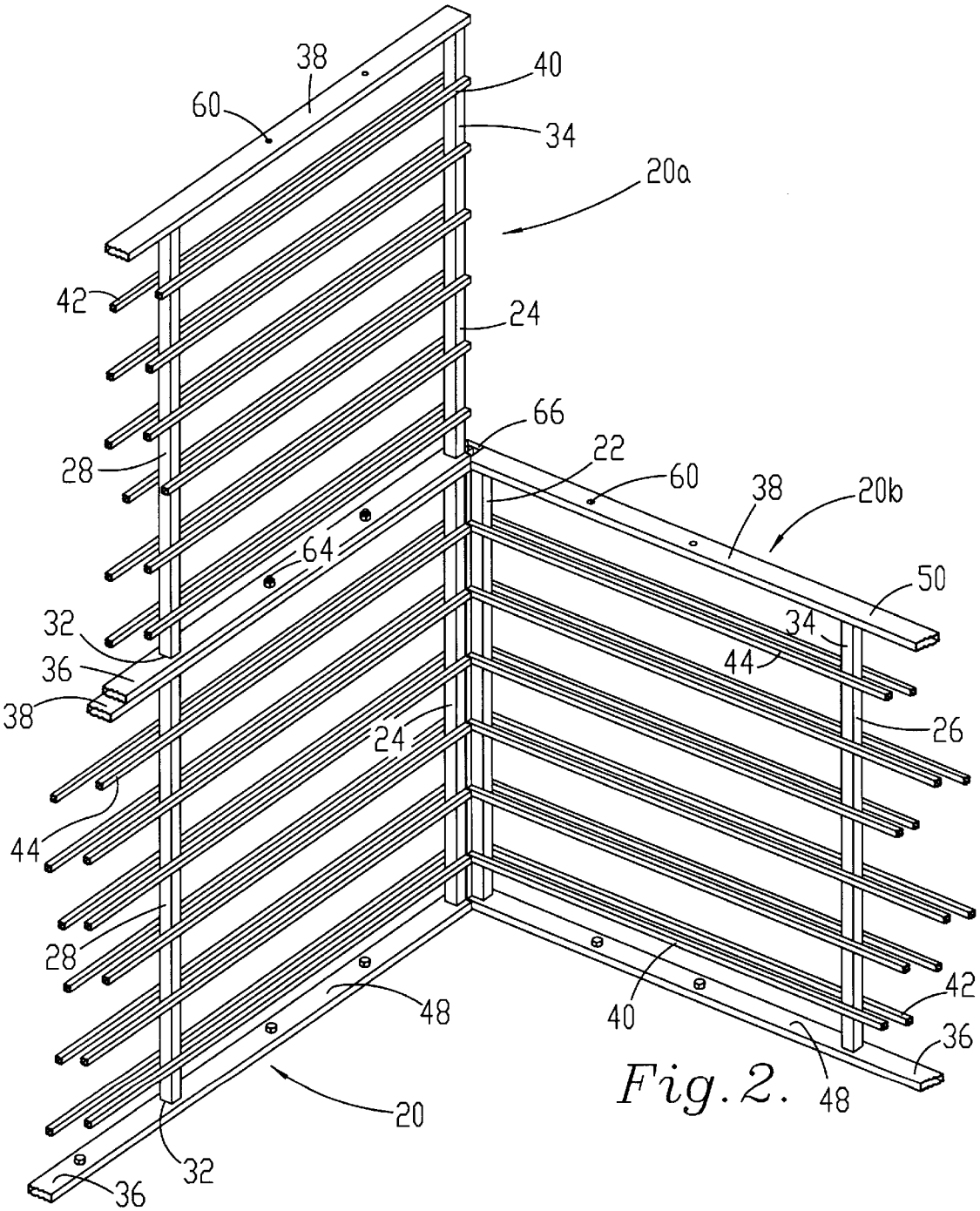
FIG. 2 is a fragmentary, pictorial view of three structural panels coupled to form a portion of a multi-story prefabricated building.
Figures 3, 4:
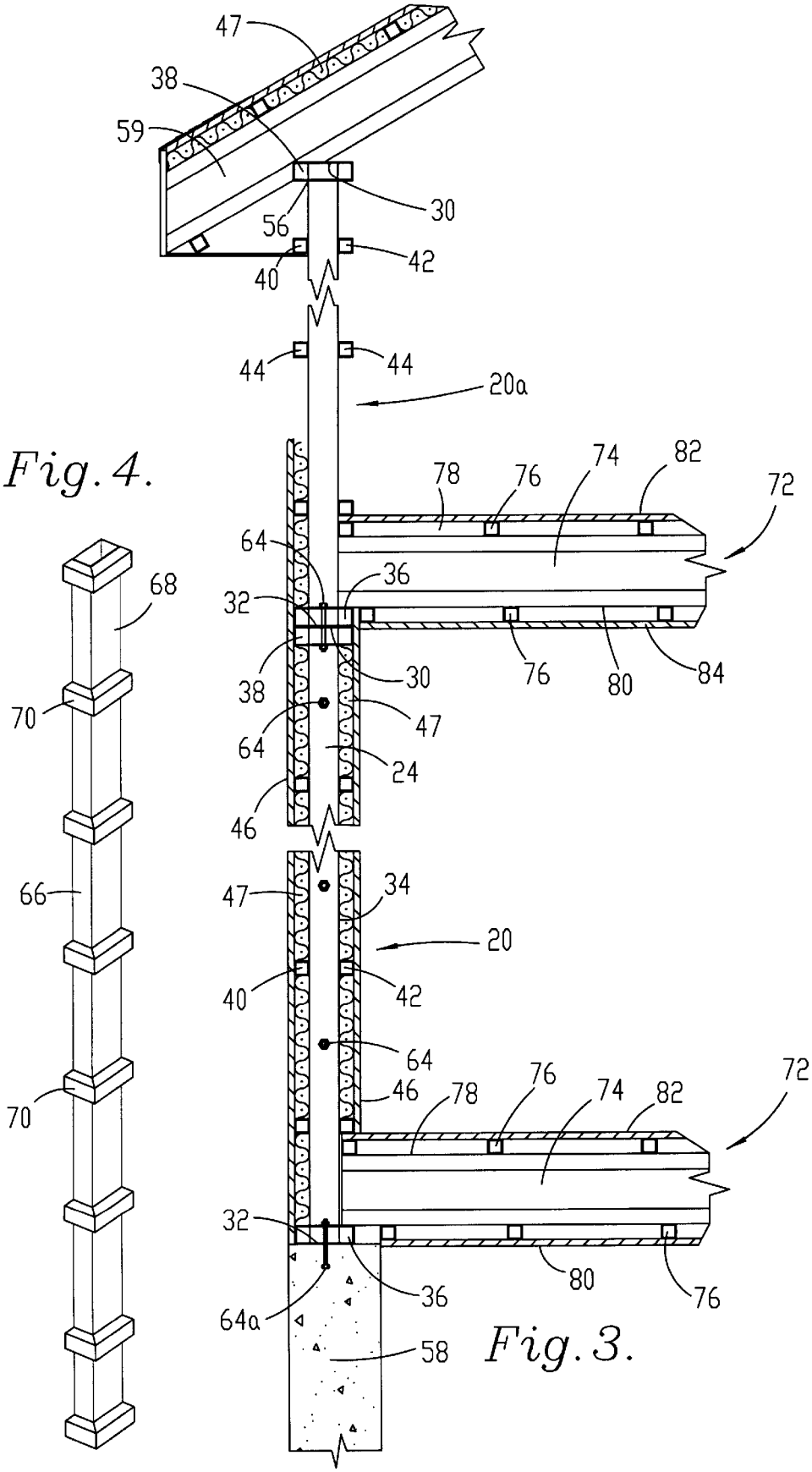
FIG. 3 is a fragmentary, vertical sectional view of two adjacent structural panels in a superposed relationship, with portions of the foundation and the first and second floor structures depicted.
FIG. 4 is a pictorial view of a corner member.

Turning to FIGS. 2 and 3, each girt 36, 38 has a plurality of bolt-receiving holes 60 therethrough to permit coupling of panel 20 with an adjacent panel 20*a* in a superposed relationship. Each hole 60 may also be used to couple panel 20 with a support surface 58 or with a roof structure 59. Each end column 22, 24 has a plurality of bolt-receiving holes 62 therethrough to permit coupling of panel 20 with an adjacent panel in a side-by-side relationship (not shown). Coupling of girts 36, 38 and columns 22, 24 in such manner is accomplished using a conventional nut and bolt set 64 that is appropriately sized to correspond to each bolt-receiving hole 60, 62. Alternatively, rivets or other similar coupling means may be used for such purposes.

Figure 7:
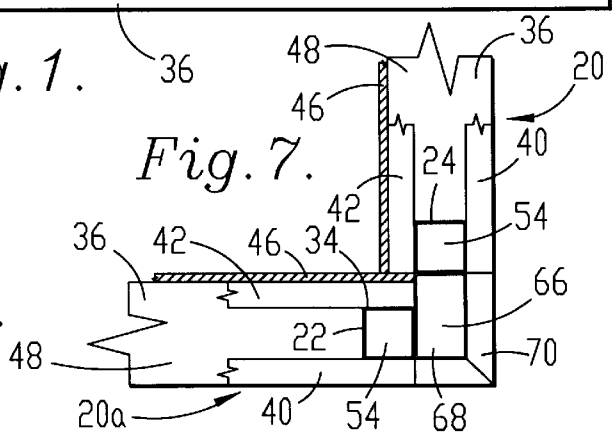
FIG. 7 is a fragmentary, plan view of two structural panels interconnecting with a corner member.

A corner member 66 is used to interconnect panel 20 with an adjacent panel 20*b* that is oriented generally transverse to panel 20, as shown in FIGS. 2 and 7. Corner member 66 includes a tubular, generally rectangular body 68 and a plurality of vertically spaced, mitred, tubular cross members 70 welded to body 68 (see FIG. 4). Body 68 and mitred cross member 70 are preferably formed of the same sheet metal material used in respect of tubular columns 22–28, girts 36, 38 and cross members 40, 42. To accommodate the attachment of wall panel elements 46 to panels 20 and 20*b* and corner member 66, each mitred cross member 70 is positioned to be in substantial horizontal and vertical alignment with cross members 40 of each adjacent panel 20, 20*b* (see FIG. 7). Corner member 66 is preferably interconnected to panels 20 and 20*b* by conventional welding. Alternatively, corner member 66 may be fabricated with bolts (not shown) extending outwardly from body 68 and configured for receipt with the corresponding bolt-receiving holes 62 in end columns 22, 24 of panels 20*b*, 20, respectively. It will be appreciated, however, that other sizes and shapes of corner members may be used depending on the type and angled configuration of wall panel elements 46 and the final installed orientation of panels 20 and 20*b*.

Footer girt 36 is configured for accommodating and supporting floor structures 72, as illustrated in FIG. 3. Although standard flooring systems may be used, floor structure 72 preferably includes a plurality of elongated, spaced, generally side-by-side, C-shaped channel girts (only one channel girt 74 is shown) and a plurality of spaced, tubular floor cross members 76 preferably welded to and interconnecting channel girts 74. Floor members 76 run generally transverse to channel girts 74 and are preferably positioned on upper and lower margins 78 and 80 of each channel girt 74. Channel girt 74 and floor cross members 76 are preferably formed of the same sheet metal material used in respect of tubular columns 22–28, girts 36, 38 and cross members 40, 42. A floor panel element 82 and an opposed ceiling panel element 84 are attached to and supported by each floor cross member 76 using conventional securing means, such as drywall screws (not shown).

Panel 20 may be prefabricated with or without a finished surface. For purposes of standardization and to reduce overall fabrication costs, each panel 20 is preferably mass produced using the following approximated dimensions:

| | |
|---|---|
| panel length | 24' |
| panel height | 9' |
| column cross sectional area | 3" × 3" |
| girt cross sectional area | 2" × 6" |
| cross member cross sectional area | 1½" × 1½" |

It should be noted that other dimensions may be used for such components as necessary, for example, to accommodate the specifications of a particular building design or as may be required by field modifications during building construction.

To construct a prefabricated building using panels 20, support surface 58 must first be constructed at the building site. If, for example, a concrete foundation is used for such purposes, upwardly extending anchor bolts 64*a* should be set in place during the casting process and positioned for receipt in the corresponding bolt-receiving holes 60 in each footer girt 36. The requisite number of panels 20 necessary to complete the building should then be delivered to the site. It will be appreciated that unlike prefabricated structures composed of wood, the preferred tubular steel panels 20 of the present invention exhibit significant rigidity and can be shipped over long distances without shaking apart or becoming loose and unstable.

Each panel 20 is next positioned in an upright, erected condition adjacent support surface 58 using a small crane or several workers. In such position, footer 36 engages support surface 58, and anchor bolts 64*a* are received within the corresponding bolt-receiving holes 60. As each panel 20 is installed in similar fashion, abutting end columns 22, 24 of adjacent panels 20 should be coupled using nut and bolt sets 64 that are threaded (but not completely tightened) through aligned bolt-receiving holes 62 in each adjacent panel 20. Corner members 66 are then welded or otherwise secured between adjacent panels 20, 20*b*, which panels are oriented generally transverse to each other. Once the first story of panels 20 is in place, each nut and bolt set 64 should be completely tightened.

Once erected, each panel 20 may be field cut in a conventional manner (e.g., using a cutting torch or metal saw) to create various sizes and types of openings (not shown) for windows, doors, ventilations grilles and other similar building materials. Such openings should then be framed in using appropriately sized tubular components that are preferably welded in place. In the same manner, panels 20 can be field cut and framed in to provide for non-standard shaped panels, such as panels for gable ends. Alternatively, such openings and such non-standard shaped panels could be laid out, cut and framed in during fabrication or in the field prior to building erection.

If the prefabricated building is a multi-story structure, a second story of panels 20*a* is next erected above and adjacent the first story of panels 20. The corresponding set of second story panels 20*a* is positioned in an upright, erected position adjacent first story panels 20. Each footer 36 of the second story of panels 20*a* engages the corresponding header 38 of the first story of panels 20. Adjacent footers 36 and headers 38 are then coupled together using nut and bolt sets 64 threaded through aligned bolt-receiving holes 60. Next, abutting end columns 22, 24 of adjacent second story panels 20*a* are coupled together in the same manner as the first story of panels 20. Finally, corner members 66 are then secured in place where necessary. Additional upper stories of panels 20*a* are erected in similar fashion.

To complete the building superstructure, roof structure 59 is positioned adjacent the uppermost story of panels 20. In such position, roof structure 59 engages headers 38 and may be coupled therewith by conventional welding. Alternatively, roof structure 59 may include downwardly extending bolts (not shown) that are received within the corresponding bolt-receiving holes 60 in headers 38 for coupling purposes.

It should be noted that panels 20 may be erected at angled, non-upright positions to accommodate various architectural styles. Further, panels 20 may be used in roof structure 59 in lieu of typical rafters and purlins or may be used as a floor system. At any time in the use of the panels, the builder has the option to convert to conventional framing back and forth using components to best advantage.

Having thus described the preferred embodiment of the present invention, the following is claimed as new and desired to be secured by Letters Patent:

What is claimed is:

1. A structural panel comprising a plurality of spaced, generally linearly, tubular columns, each column presenting opposed sides and opposed first and second column ends, two of said columns being opposed end columns;

a tubular header interconnecting said first ends of said columns;

a tubular footer interconnecting said second ends of said columns; and a plurality of spaced, tubular cross members oriented generally transverse to said columns, each of said cross members interconnecting said columns along one of said column sides and presenting a length not less than the distance between said two end columns.

2. The panel of claim 1, said cross members are positioned on opposite sides of said columns.

3. The panel of claim 2, said cross members are arranged in pairs positioned on opposite sides of said columns in registry with each other.

4. The panel of claim 1, said panel includes four of said columns.

5. The panel of claim 1, said columns each presenting a generally rectangular cross-section, said header presenting a generally rectangular cross-section, said footer presenting a generally rectangular cross-section, and said cross members each presenting a generally rectangular cross-section.

6. The panel of claim 5, said columns, header, footer and cross members each are comprised of formed sheet metal.

7. The panel of claim 1, said cross members positioned on one of said column sides, said cross members presenting outboard faces generally co-planar with each other.

8. The panel of claim 7, said cross member outboard faces configured for attaching to and supporting a wall panel element.

9. The panel of claim 1, said header being welded to said first ends of said columns, said footer being welded to said second ends of said columns, said cross members being welded to said column sides.

10. The panel of claim 1, said header and footer each presenting opposed first and second exterior surfaces and opposed first and second interior surfaces, said first exterior surface and said first interior surface cooperatively defining at least two column-receiving openings therethrough, said column end being configured for engaging said second interior surface when said column is received within a corresponding one of said openings.

11. The panel of claim 1, said footer configured for supporting said columns and thereby said panel in an upright erected position.

12. The panel of claim 11, said headers being configured for coupling with said footers of an additional, upper story panel and thereby supporting said additional panel in a superposed relationship.

13. The panel of claim 1, each end column being configured for coupling with an end column of an adjacent panel in a side-by-side relationship.

14. The panel of claim 13, said end columns and said header and footer each defining at least one bolt-receiving hole therethrough.

15. The panel of claim 1, said tubular columns, footer and header and cross members each defining a conduit run therein sized for receiving elongated building materials selected from the group consisting of wires, cables and pipes.

16. The panel of claim 1, said panel including four of said columns, said cross members being arranged in pairs positioned on opposite sides of said columns in registry with each other, said tubular columns, footer, header and cross members each comprised of formed sheet metal and presenting a generally rectangular cross section, said girts each presenting an outboard face, said cross members positioned on one of said column sides presenting outboard faces generally co-planar with each other, said header being welded to said first ends of said columns, said footer being welded to said second ends of said columns, said cross members being welded to said column sides, said header and footer each presenting opposed first and second exterior surfaces and opposed first and second interior surfaces, said first exterior surface and said first interior surface cooperatively defining at least two column-receiving openings therethrough, said column end being configured for engaging said second interior surface when said column is received within a corresponding one of said openings, said footer configured for supporting said columns and thereby said panel in an upright erected position.

17. A prefabricated building comprising:

a plurality of structural panels, each of said panels including a plurality of spaced, generally linearly, tubular columns, each column presenting opposed sides and opposed first and second column ends;

a tubular header interconnecting said first ends of said columns;

a tubular footer interconnecting said second ends of said columns;

a plurality of spaced, tubular cross members oriented generally transverse to said columns, each of said cross members interconnecting said columns along one of said column sides and presenting a length not less than the distance between said two end columns;

at least two of said columns of each panel being opposed end columns interconnected with end columns of adjacent panels, said footer configured for coupling with a support surface, said panels being positioned to cooperatively present walls of the building; and a roof structure coupled with said headers.

18. The building of claim 17, said headers being coupled with said footers of a plurality of additional, upper story panels and thereby supporting said upper story panels in a superposed relationship, said roof structure being coupled with said headers of said upper story panels.

19. The building of claim 17, said roof structure including a plurality of said panels.

20. The building of claim 17, a plurality of said cross members of at least one of said panels defining an opening cut therein sized to accommodate building materials selected from the group consisting of windows, doors and ventilation grilles.

21. The building of claim 17, said panel including four of said columns, said cross members being arranged in pairs positioned on opposite sides of said columns in registry with each other, said tubular columns, footer, header and cross members each comprised of formed sheet metal and presenting a generally rectangular cross section, said footer and header each presenting an outboard face, said cross members positioned on one of said column sides presenting outboard faces generally co-planar with each other, said header being welded to said first ends of said columns, said footer being welded to said second ends of said columns, said cross members being welded to said column sides, said header and footer each presenting opposed first and second exterior surfaces and opposed first and second interior surfaces, said first exterior surface and said first interior surface cooperatively defining at least two column-receiving openings therethrough, said column end being configured for engaging said second interior surface when said column is received within a corresponding one of said openings.

22. A method of constructing a prefabricated building comprising the steps of:

(a) providing a plurality of structural panels, each of said panels including a plurality of spaced, generally linearly, tubular columns, each column presenting opposed sides and opposed first and second column ends, two of said columns being opposed end columns;

a tubular header interconnecting said first ends of said columns;

a tubular footer interconnecting said second ends of said columns, one of said girts of each panel being a footer, the other of said girts being a header; and a plurality of spaced, tubular cross members oriented generally transverse to said columns, each of said cross members interconnecting said columns along one of said column sides and presenting a length not less than the distance between said two end columns;

(b) positioning one of said panels adjacent a support surface such that said footer of said one panel engages the support surface;

(c) coupling said footer of said one panel with the support surface;

(d) repeating step (c) for another of said panels positioned adjacent said one panel such that one of said end columns of said one panel is adjacent and engages one of said end columns of said other panel;

(e) coupling said adjacent end columns of said panels;

(f) repeating steps (d) and (e) for additional panels such that said panels are positioned to cooperatively present walls of the building and a first story of said panels is erected;

(g) providing a roof structure;

(h) positioning said roof structure adjacent said headers of said first story of panels such that said roof structure engages said first story panel headers; and (I) coupling said roof structure with said first story panel headers.

23. The method of claim 22, including the steps of erecting a second story of said panels by positioning a corresponding set of second story panels adjacent said first story panels such that said footers of said second story panels are adjacent and engage the corresponding headers of said first story panels and one of said end columns of each second story panel is adjacent and engages one of said end columns of another of said second story panels, coupling said second story footers with the corresponding first story headers, coupling said adjacent end columns of said second story panels, positioning said roof structure adjacent said headers of said second story panels such that said roof structure engages said second story panel headers, and coupling said roof structure with said second story panel headers.

24. The method of claim 22, including the step of cutting a plurality of said cross members of at least one of said panels to define an opening sized to accommodate building materials selected from the group consisting of windows, doors and ventilation grilles.

25. The method of claim 22, said roof structure including a plurality of said panels.

26. The method of claim 22, said panel including four of said columns, said cross members being arranged in pairs positioned on opposite sides of said columns in registry with each other, said tubular columns, header, footer and cross members each comprised of formed sheet metal and presenting a generally rectangular cross section, said header and footer each presenting an outboard face, said cross members positioned on one of said column sides presenting outboard faces generally co-planar with each other, said header being welded to said first ends of said columns, said footer being welded to said second ends of said columns, said cross members being welded to said column sides, said header and footer each presenting opposed first and second exterior surfaces and opposed first and second interior surfaces, said first exterior surface and said first interior surface cooperatively defining at least two column-receiving openings therethrough, said column end being configured for engaging said second interior surface when said column is received within a corresponding one of said openings.

* * * * *